US009370796B2

(12) United States Patent
Maynard

(10) Patent No.: US 9,370,796 B2
(45) Date of Patent: Jun. 21, 2016

(54) PARTICLE SEPARATOR

(71) Applicant: SIZE REDUCTION SPECIALISTS CORP., East Lansing, MI (US)

(72) Inventor: Donald Maynard, East Lansing, MI (US)

(73) Assignee: Size Reduction Specialists Corp., East Lansing, MI (US)

( * ) Notice: Subject to any disclaimer, the term of this patent is extended or adjusted under 35 U.S.C. 154(b) by 47 days.

(21) Appl. No.: 14/055,687

(22) Filed: Oct. 16, 2013

(65) Prior Publication Data

US 2015/0101964 A1 Apr. 16, 2015

(51) Int. Cl.

| | |
|---|---|
| ***B07B 1/18*** | (2006.01) |
| ***B07B 1/06*** | (2006.01) |
| ***B03C 1/26*** | (2006.01) |
| ***B07B 1/20*** | (2006.01) |
| ***B03C 1/035*** | (2006.01) |
| ***B03C 1/10*** | (2006.01) |
| ***B03C 1/28*** | (2006.01) |
| ***B03C 1/30*** | (2006.01) |

(52) U.S. Cl.

CPC . *B07B 1/06* (2013.01); *B03C 1/035* (2013.01); *B03C 1/10* (2013.01); *B03C 1/26* (2013.01); *B03C 1/286* (2013.01); *B03C 1/30* (2013.01); *B07B 1/20* (2013.01); *B03C 2201/20* (2013.01); *B03C 2201/28* (2013.01)

(58) Field of Classification Search

CPC ..... B07B 1/18; B07B 1/20; B07B 1/24; B07B 4/06; B07B 7/00; B07B 7/08; B07B 7/083; B07B 7/086; B03C 1/00; B03C 1/247

USPC ..... 209/285, 288, 293, 294, 296, 298, 299

See application file for complete search history.

(56) References Cited

U.S. PATENT DOCUMENTS

| | | | | | |
|---|---|---|---|---|---|
| 221,453 | A | * | 11/1879 | Fisher | 460/98 |
| 323,726 | A | * | 8/1885 | Payne | 209/411 |
| 1,617,688 | A | * | 2/1927 | O'Toole | 209/284 |
| 2,811,158 | A | * | 10/1957 | Rietmann | 460/80 |
| 3,122,499 | A | * | 2/1964 | Witzcl et al. | 209/21 |
| 3,455,452 | A | * | 7/1969 | Yetter | 209/297 |
| 3,463,314 | A | * | 8/1969 | Feterl | 209/254 |
| 3,672,505 | A | * | 6/1972 | Feterl | 209/264 |
| 3,886,063 | A | * | 5/1975 | Friesz | 209/44 |

(Continued)

*Primary Examiner* — Joseph C Rodriguez
*Assistant Examiner* — Kalyanavenkateshware Kumar
(74) *Attorney, Agent, or Firm* — Avery N. Goldstein; Blue Filament Law

(57) ABSTRACT

A particle separator is provided that separates small particulate from large particulate from an intermixed material feed. The separator finds particular utility in the field of separation of thermoplastic regrind particulate from intermixed debris which constitutes a smaller particulate relative to the thermoplastic regrind. Embodiments of the separator use a rotary shaft for mounting an spiral blade fed by a material feeder bin that meters material into the separator. The spiral blade is configured so that the material moves along a peripheral mesh screen to separate any smaller particulate that passes through the mesh screen leaving the large particulate to traverse though the separator, while small particulate is sieved therefrom the surrounding mesh and into a separate collection stream. The spiral blade is mounted to a central magnetic axis to achieve removal of unwanted foreign spurious metal shavings or particulate that may be introduced to molding materials due to mechanical wear of the processing machinery.

19 Claims, 5 Drawing Sheets

(56) References Cited

U.S. PATENT DOCUMENTS 4,919,642 A * 4/1990 Sukup et al. ..... 460/80
5,051,177 A * 9/1991 Dauchez ..... B03C 1/12 209/219
5,507,396 A * 4/1996 Hauch ..... 209/399
5,957,301 A * 9/1999 Wedel et al. ..... 209/173
6,561,359 B2 * 5/2003 Egge et al. ..... 209/44
8,051,988 B2 * 11/2011 Farley ..... 209/293
2011/0203976 A1 * 8/2011 Baker ..... B03C 1/0332 209/214
2012/0298563 A1 * 11/2012 Maynard et al. ..... 209/235

* cited by examiner

PARTICLE SEPARATOR

FIELD OF THE INVENTION

The present invention in general relates to a particle separator and in particular to a rotary shaft separator having an auger mounted to a central rotary magnetic axial shaft or core to allow gravity fed material containing large particles and small particles to successively traverse down the auger as the rotary magnetic shaft is turned to selectively allow smaller particulate to pass through a screen mesh surrounding the rotary shaft, while spurious magnetic particulate is captured by the magnetic shaft.

BACKGROUND OF THE INVENTION

Thermoplastic molding produces sprues and other pieces of scrap thermoplastic material in the course of molding articles. Rather than discard this scrap material, it is conventional to the art to grind such scrap into comparatively uniform sized particulate amountable to intermixing with virgin thermoplastic pellets for reprocessing through the molding process. Unfortunately, it is common that debris becomes intermixed with the pelletized thermoplastic scrap. Such debris can compromise the quality of a molded article through creation of an inhomogeneity. This problem is especially severe when molding transparent articles in which debris can form a visually discernible inclusion. Further, depending on the processing conditions and the nature of the debris, charring of the debris can occur resulting in a visually discernable black inclusion.

Furthermore, unwanted foreign spurious metal shavings or particulate may be introduced to molding materials due to mechanical wear of processing machinery. The introduction of metal shavings may also have adverse effects on the molding material properties, performance, and surface finish.

In response to the problems associated with debris becoming entrained with a regrind particle stream or indeed a virgin thermoplastic particle stream, the separators are conventionally used to remove such debris. Conventional separators have included vibratory separators in which material is loaded on to a size exclusion mesh and either manually or mechanically oscillated to shake the debris through the mesh thereby leaving comparatively debris free particulate. However, such vibratory separation schemes require a considerable amount of space and are kinetically slow in separating debris from particulate as a result of electrostatic attraction between the debris and particulate resulting in interparticle transfer of debris as the debris traverses through the particulate before being sieved from the particulate. In response to the limitations of vibratory separation techniques, pressurized air flows have been utilized to flow over a monolayer or several monolayers of particulate to drive the comparatively lighter mass debris from the particles. A number of such systems have also utilized a conveyor or other movement of the material to facilitate such separation. However, pressurized air separation techniques tend to be complex and difficult to maintain on to the inclusion of an air compressor and particle conveyance equipment that increase the footprint of such a separator as well as cost of usage.

Thus, there exists a need for a particle separator that achieves high throughput separation of particulate from debris and foreign metallic mater, and does so with limited complexity and moving components. There further exists a need for a particle separator having a small footprint and operative without a pressurized countercurrent gas flow across the material to be separated

SUMMARY OF THE INVENTION

A particle separator is provided that separates small particulate from large particulate from an intermixed material feed. Embodiments of the present invention finds particular utility in the field of separation of thermoplastic regrind particulate from intermixed debris which constitutes a smaller particulate relative to the thermoplastic regrind. Embodiments of the inventive separator use a central shaft for mounting a surrounding spiral blade by a material feeder bin that meters material into the separator with an encompassing peripheral mesh screen. Embodiments of the spiral blade are configured so that the material moves along a peripheral mesh screen to separate any smaller particulate that passes through the mesh screen leaving the large particulate to traverse though the separator, while small particulate is sieved therefrom the surrounding mesh and into a separate collection stream. The central axis in some embodiments includes a magnet that attracts unwanted foreign spurious metal shavings or particulate that may be introduced to molding materials due to mechanical wear of the processing machinery. In other embodiments, the central tube has a pressurized gas stream to induce material separation between large and small particulate emitted outward along the axis via slits in the tube towards the peripheral mesh screen. Attributes particularly beneficial to the inventive separator include compact footprint and the ability to separate through the use of rotation and gravitational forces.

BRIEF DESCRIPTION OF THE DRAWINGS

The subject matter that is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

Figure 1:
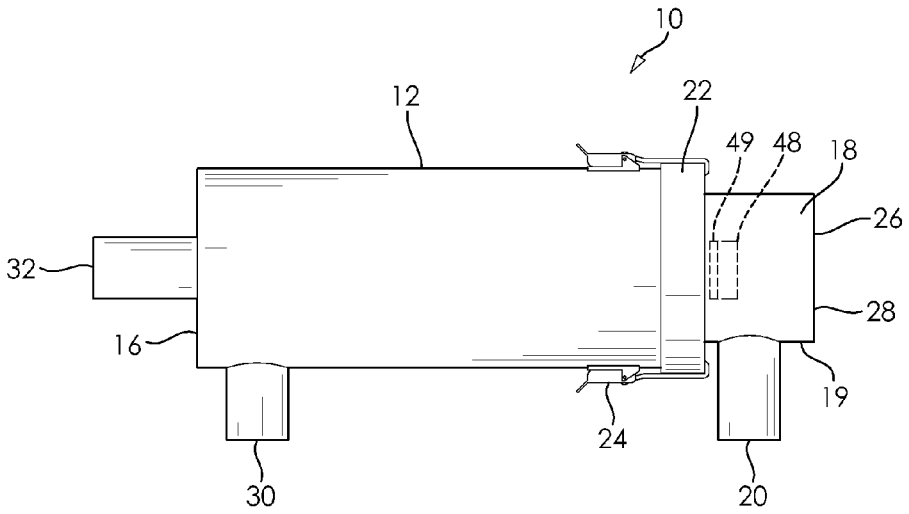
FIG. 1 illustrates a schematic diagram of an embodiment of the inventive particle separator.

The detailed description explains the preferred embodiments of the invention, together with advantages and features, by way of example with reference to the drawings.

DESCRIPTION OF THE INVENTION

The present invention has utility as a separator of small particulate from large particulate from an intermixed material feed. The present invention finds particular utility in the field of separation of thermoplastic regrind particulate from intermixed debris which constitutes a smaller particulate relative to the thermoplastic regrind. An inventive separator uses a rotary shaft for mounting a spiral blade fed by a material feeder bin that meters material into the separator. The spiral blade is configured so that the material moves along a peripheral mesh screen to separate any smaller particulate that passes through the mesh screen leaving the large particulate to traverse though the separator, while small particulate is sieved therefrom the surrounding mesh and into a separate collection stream. The spiral blade is mounted to a central magnetic axis that attracts unwanted foreign spurious metal shavings or particulate that may be introduced to molding materials due to mechanical wear of the processing machinery. Attributes particularly beneficial to the inventive separator include compact footprint and the ability to separate through the use of rotation and gravitational forces. While one can resort to use of a pressurized gas stream to induce material separation between large and small particulate, such pressurized gas stream is not essential thereby simplifying the separation process.

With reference to the attached figures, an inventive particle separator is depicted generally at 10. The separator 10 includes a housing or separator enclosure 12 having a first end 14 that is synonymously referred to herein as an inlet opening and a second end 16 that is synonymously referred to herein as an outlet. Separator enclosure 12 serves to protect a material M to be separated from environmental contamination, and reduce environmental dusting associated with the separation process. The separator enclosure 12 is readily formed of conventional materials including sheet metal, plastics, wood, and combinations thereof. Optionally, part or all of the separator enclosure 12 is transparent to allow for quick visual inspection as to the operation of the inventive separator 10. Optionally, the separator enclosure 12 has a circular cross-section, however other cross-sectional shapes, including but not limited to rectangular, square, and oval may be used for the cross-section. The length of the separator enclosure 12 may range between 6 to 24 inches, and more preferably 12 to 18 inches, and still more preferably a length of approximately 14 to 16 inches.

Proximal to the first end 14 a particle feed bin 18 is formed that includes a bottom surface 19 having an input aperture coupling 20 therein so as receive the feed material M. Input aperture coupling 20 is configured to engage a feeder line, such as line 56 that will be discussed further in FIG. 4 below. Particle feed bin 18 has an end cover 26 that secures to feed bin 18 with removable fastener 28. Lip seal region 22 fits over first end 14 of separator enclosure 12 to form a secure seal between separator enclosure 12 and particle feed bin 18, when latches 24 are engaged to lip seal region 22 and the latches 24 are in a closed position.

Proximal to the second end 16 dust and fines that form the small rejected materials, which pass through a mesh screen as described in FIGS. 2-4 below, are exited through rejection aperture coupling 30, and the larger particulate materials that form reusable materials are exited through reuse aperture coupling 32.

Figure 2:
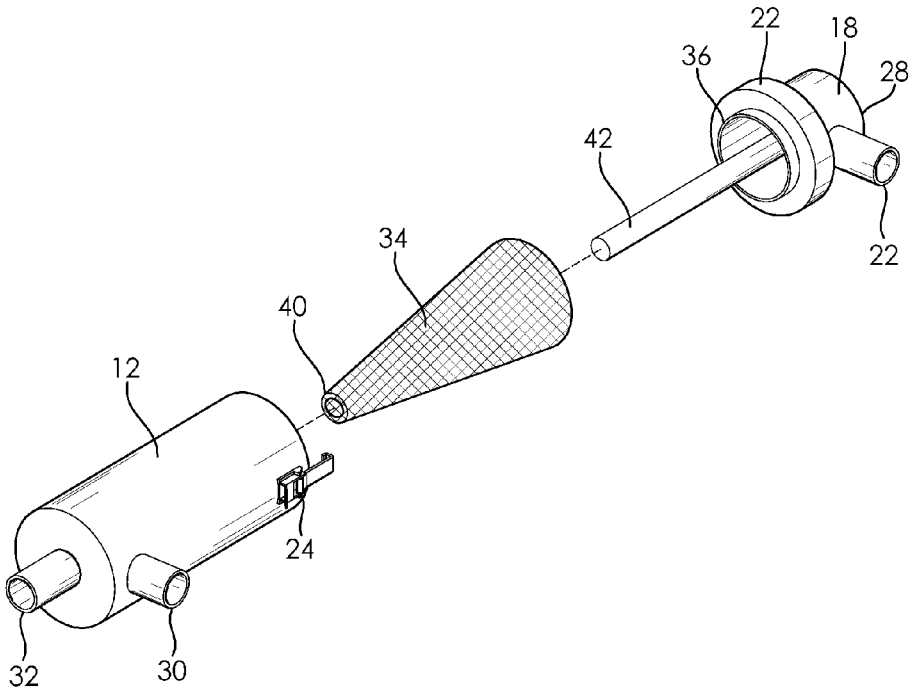
FIG. 2 illustrates a view of a disassembled embodiment of the inventive particle separator with a conical mesh screen chamber shown and a central magnetic axis for accommodating an spiral blade attached to the feed bin.

FIG. 2 illustrates a view of a disassembled embodiment of the inventive particle separator 10 with a conical mesh screen chamber 34 shown and a central magnetic axis 43 for accommodating an spiral blade (44 in FIG. 3B) attached to the feed bin 18. Conical mesh screen chamber 34 has a proximal end 38 with an opening diameter that approximates the dimensions of feed bin 18 and mates up to end 36 of feed bin 18 found below lip seal region 22. The distal end 40 of the conical mesh 34 that has an opening diameter that approximates the reuse aperture coupling 32. The apertures or openings in the screen material of the conical mesh screen chamber 34 may vary in shape and size or may be homogenous along the length of the conical mesh screen chamber 34. The apertures or opening size and shapes as well as distribution or pattern are determined based on the size and types of material to be separated.

Figure 3A:
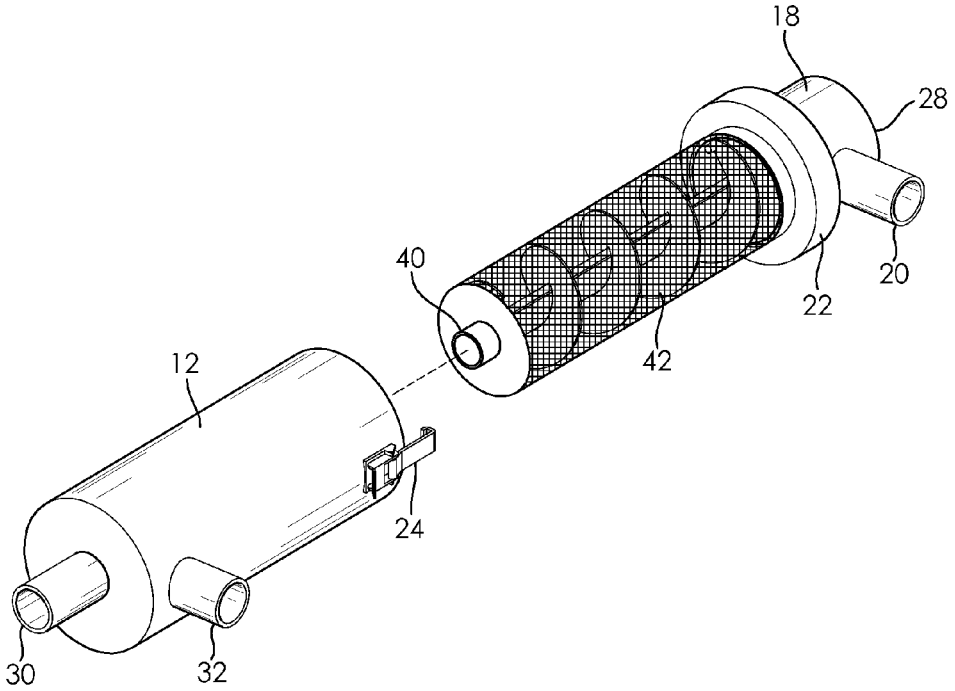
FIG. 3A illustrates a view of a partially disassembled embodiment of the inventive particle separator with a cylindrical mesh screen.
Figure 3B:
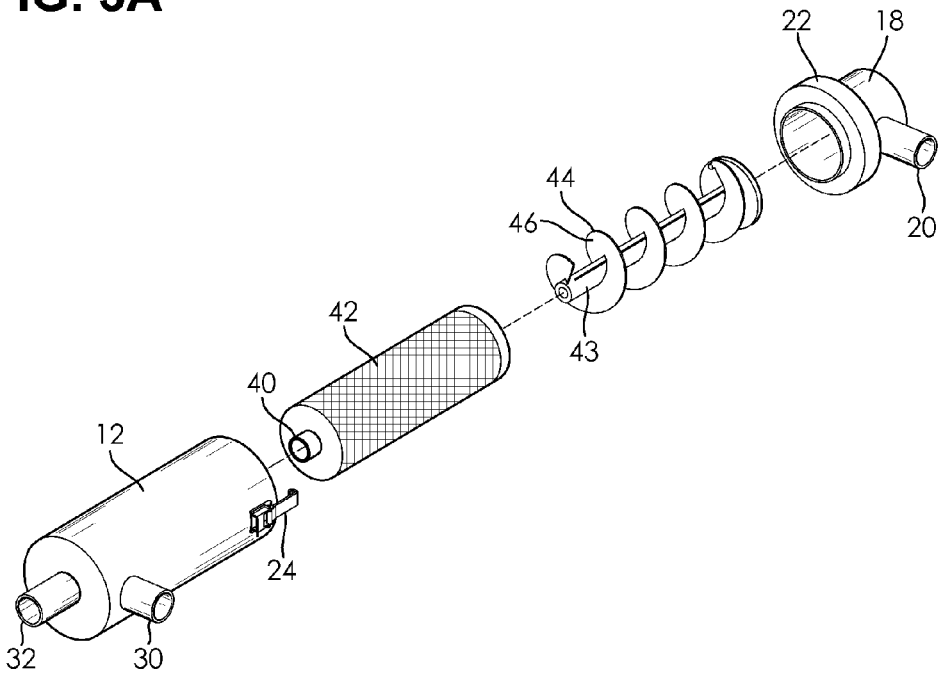
FIG. 3B illustrates a view of the embodiment of the inventive particle separator of FIG. 3A with the cylindrical mesh screen chamber disassembled to show the spiral blade mounted to the central magnetic axis.

The central magnetic axis 43 is either fixed or movably attached to end 36 of feed bin 18. The central magnetic axis 43 acts to attract unwanted foreign spurious metal shavings or particulate that may be introduced to molding materials due to mechanical wear of the processing machinery. Periodically, or on a need basis, the central magnetic axis 43 is removed from the separator 10 to remove any collected metallic debris that is adhering to the central magnetic axis 43. As shown in FIG. 3B (removed in FIG. 2) a spiral blade 44 is fitted to the central magnetic axis 43. The spiral blade 44 is either fixed or movably attached to the central magnetic axis 43. The spiral blade 44 shown in FIG. 3B has a constant width which matches the non-tapered circular cross-section cylindrical mesh 42. It is noted that for the conical mesh screen chamber 34 shown in FIG. 2, that the corresponding conical spiral blade that is not shown mounted to central magnetic axis 43 would have a tapered shape. The spiral blades 46 are angled so as to direct or urge material M that contains large particles with small particles into moving contact with the separating mesh or screen (34, 42).

Alternatively, the spiral blade 44 is stationary, and as will be described in the system illustrated in FIG. 4, the force of air pressure in a closed system pushes the material M down the spiral blade, with the angle of the spiral blades pushing the material M against the mesh to separate large and small particles into separate streams.

Figure 3C:
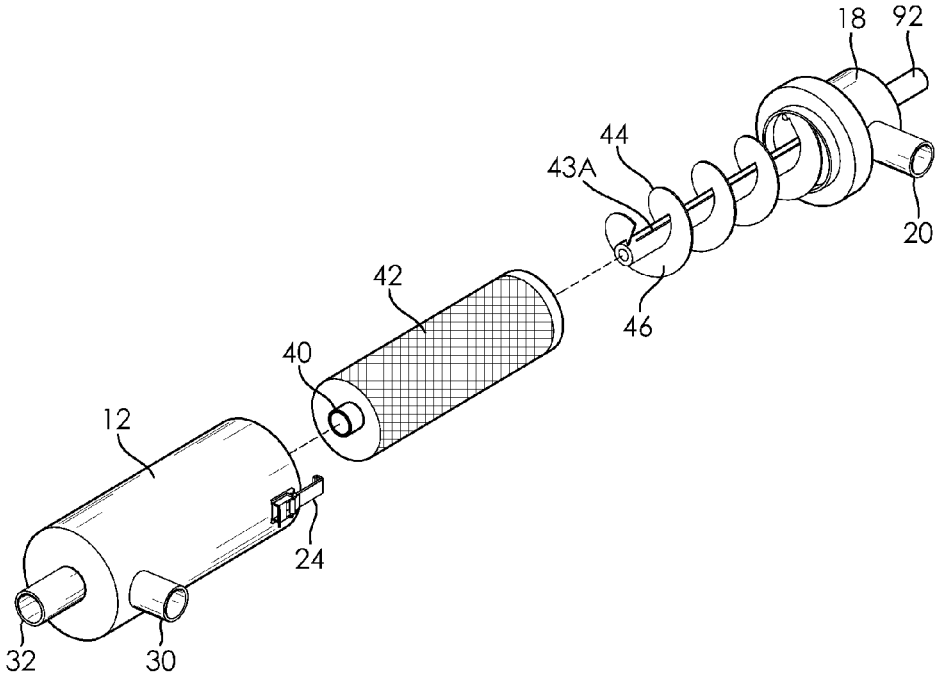
FIG. 3C illustrates an exploded view of an embodiment of the inventive particle separator with an air input.
Figure 3D:
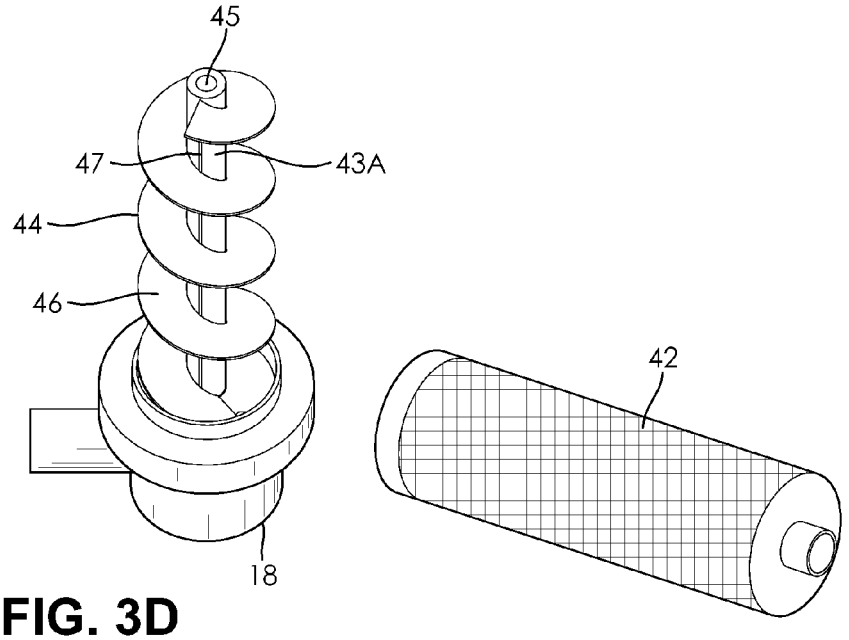
FIG. 3D illustrates the spiral blade of FIG. 3C with a diametric slit visible that is in fluid communication with the air input and the air conduit.
Figure 3E:
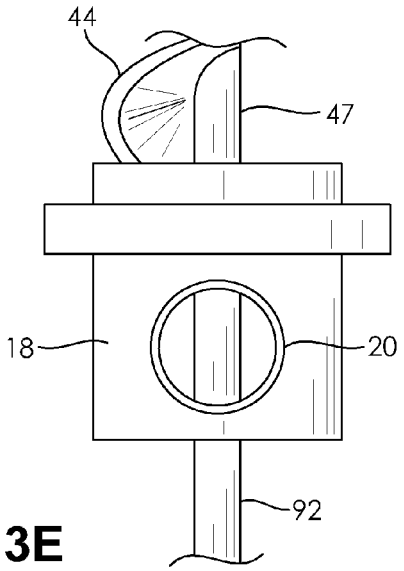
FIG. 3E is a detail view of the particle feed bin with the air input and the diametric slit.
Figure 5:
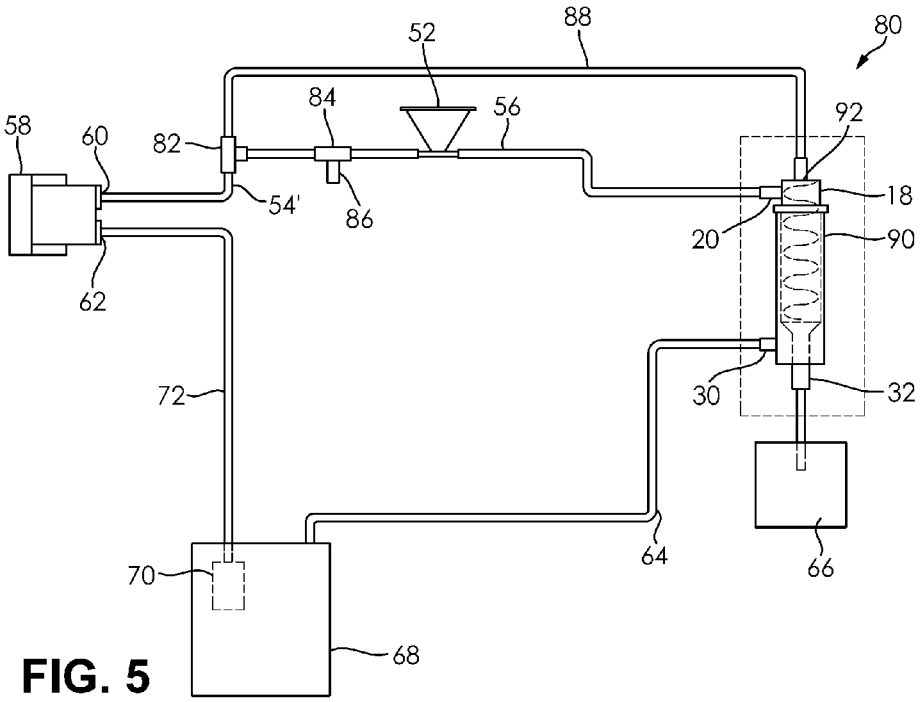
FIG. 5 illustrate a view of an additional embodiment of an inventive particle separator system with a second air supply line fed in to the hopper of the separator.
Figure 6:
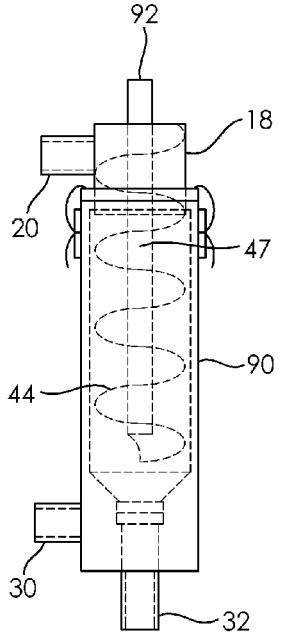
FIG. 6 is detail view of the inventive particle separator of FIG. 5.

FIG. 3C illustrates an exploded view of an embodiment of the inventive particle separator with an air input 92 in fluid communication with an air conduit 45 within central axis 43A. As shown in FIG. 3D, one or more slits 47 provide an opening from the air conduit 45 that provides an outward flow of air that urges material M into moving contact with the separating mesh or screen 42. In an inventive embodiment, the slits 47 are on diametrically opposing sides of the axis 43A. It is appreciated that more than two slits are also employed along the length of the axis 43A, as well as the slits need not being diametrically opposed. It is further appreciated that the width of each slit is varied independent of the other slit. FIG. 3D illustrates the spiral blade of FIG. 3C with a diametric slit 47 visible that is in fluid communication with the air input 92 and the air conduit 45. FIG. 3E is a detail view of the particle feed bin 18 with the air input and the diametric slit; FIGS. 5 and 6 illustrate a system level view of the inventive particle separator with an air input 92 connected to air supply line 88.

Figure 4:
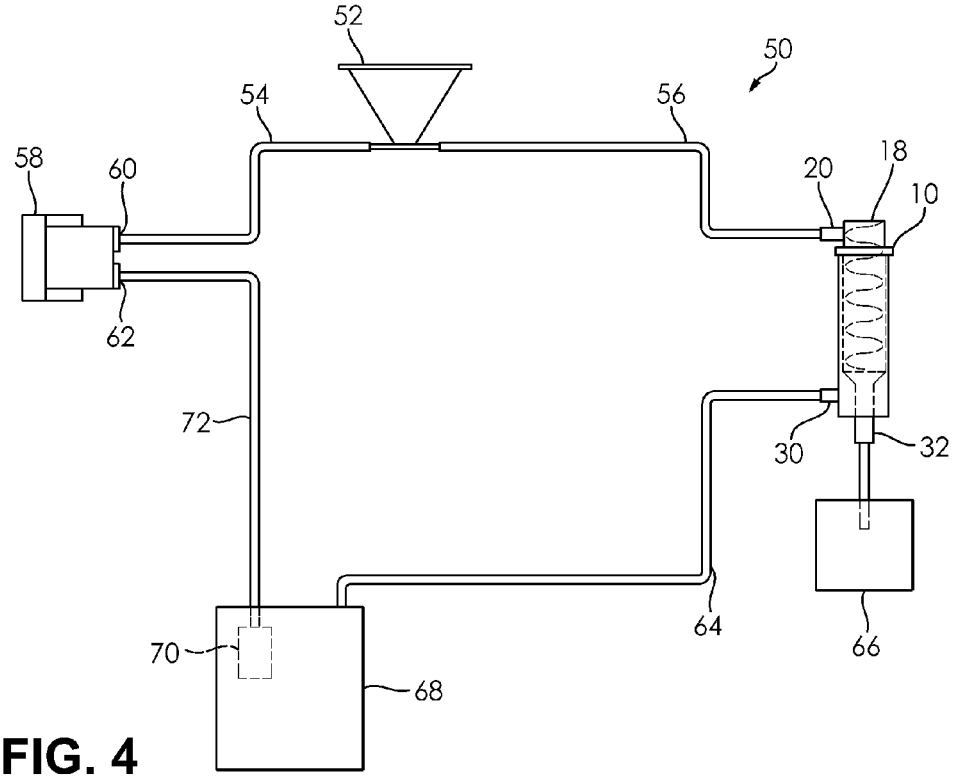
FIG. 4 illustrates a view of an embodiment of an inventive particle separator system.

FIG. 4 illustrates a view of an embodiment of an inventive particle separator system 50. Separator system 50 is a closed air system with a compressor or pump 58, such as a ring compressor blower. The compressor or pump 58 has an output air supply 60, and an inlet air return 62. Output air supply 60 connects to a material collector funnel (hopper) 52 via a first portion of air supply line 54. The material collector funnel 52 receives material M from a grinder (not shown), where the material M contains large particles L with small particles S and potential metal shavings and debris. A second portion of air supply line 56 runs from the material collector 52, and acts as a feeder line to input aperture coupling 20 of feed bin 18 of separator 10. Separator 10 provides a stream of larger particles L that is free of smaller particles and potential metal shavings and debris, where the metal shavings are attracted to the central axis 43 (shown in FIGS. 2 and 3B), via reuse aperture coupling 32 to a collection bin 66 for clean material for further use in material production or processing. Smaller particles S (dust and fines) that pass through the mesh surface within the separator 10 exit via rejection aperture coupling 30. The rejection aperture coupling 30 is joined via line 64 to a holding barrel 68. Air that enters the holding barrel 68 is passed through a filter 70 before returning to the compressor or pump 58 input 62 via return line 72.

In operation, material M is collected from a grinder and enters a circulated air stream of a closed system that is generated by a compressor. The air stream with the material M is supplied to the separator. Within the separator, small particles S are able to pass through the screen mesh thereby leaving the material M enriched in large particles L. Material M that traverses the length of the separator is then collected at large particle outlet and deposited in a collection bin. It is appreciated that depending on the nature of the material M, the large particulate fraction L, small particulate fraction S, are both represent desired collection streams. In the exemplary case of thermoplastic regrind, typically, the large particle fraction L is desired while the small particle fraction S constitutes undesired debris. A central axis within the separator acts to attract unwanted metallic debris within the material M. It is appreciated that an inventive separator is also well suited for separation of grains and other agricultural products. An inventive separator has the attribute of achieving desired separations with a small footprint amid high degree of adjustment to accommodate different sized distribution materials M.

FIG. 5 illustrates a view of an embodiment of an inventive particle separator system 80. Separator system 80 is a closed air system with a compressor or pump 58, such as a ring compressor blower. The compressor or pump 58 has an output air supply 60, and an inlet air return 62. Output air supply 60 connects to a T-junction 82 via air supply line 54'. The T-junction 82 splits the air supplied to a supply line 84 in communication with material collector funnel (hopper) 52, and air supply line 88 that is connected to the feeder bin 18 of separator 90 via input 92. Air supplied via line 88 and into input 92 urges material down the spiral blade 44 of separator 90. Air bleed-off valve 86 adjusts pressure in the system 80. The material collector funnel 52 receives material M from a grinder (not shown), where the material M contains large particles L with small particles S and potential metal shavings and debris. A second portion of air supply line 56 runs from the material collector 52, and acts as a feeder line to input aperture coupling 20 of feed bin 18 of separator 90. Separator 90 provides a stream of larger particles L that is free of smaller particles and potential metal shavings and debris, where the metal shavings are attracted to the central axis 43 (shown in FIGS. 2 and 3B), via reuse aperture coupling 32 to a collection bin 66 for clean material for further use in material production or processing. Smaller particles S (dust and fines) that pass through the mesh surface within the separator 10 exit via rejection aperture coupling 30. The rejection aperture coupling 30 is joined via line 64 to a holding barrel 68. Air that enters the holding barrel 68 is passed through a filter 70 before returning to the compressor or pump 58 input 62 via return line 72. The air supplied via line 88 to the separator 90 urges the material M through the separator 90.

FIG. 6 is detail view of the inventive particle separator 90 used in the system 80 as shown in FIG. 5. Material M enters the separator 90 in to the feed bin 18 and strikes the blades of the spiral blade 44, where the angle of contact of the inputted material M contacts the downward twisting portion of the spiral blade 44, as opposed to an orthogonal surface of the spiral blade 44. It has been surprisingly found that the incident angle of M on spiral blade 44 effects if material M is urged downward into the length of the spiral blade 44 or instead backs up into the head of the separator 90.

Figure 7:
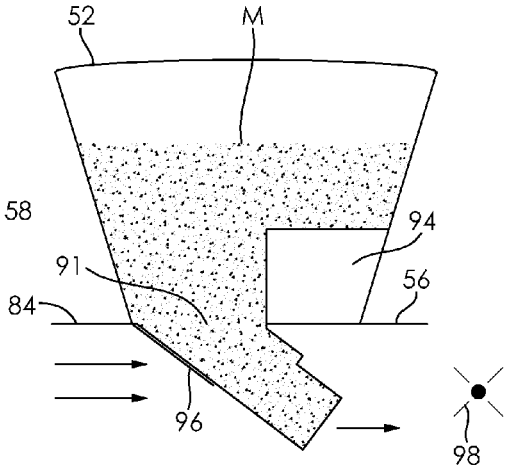
FIG. 7 is a detail view of the collector of FIG. 6 with a deflector and paddle wheel in the air supply line.

FIG. 7 is a cross-section detail view of the collector 52 of FIG. 5 with a constricting facing 94, and a deflector 96 and paddle wheel 98. The deflector 96 dips into the flow of air from line 84 on the upstream side of outlet 91 of the collector 52, and the flat face region 94 above the airflow acts to prevent a vortex from swirling into the collector, and instead creates a venturi that pulls the material M granules in to the air stream of line 56. Paddle wheel 98 in air supply line 56 moderates the flow of material M, and prevents spikes in air pressure.

In an alternative embodiment, separation may be achieved through a motor driven spiral blade within the separator and does so without resort to a pressurized gas stream contacting the material. While such a pressurized gas stream is recognized to be operative with the present invention, usage of a pressurized gas stream such as air is noted to increase complexity of the overall separation process as well as promoting undesirable charging of material M through electrostatics.

The foregoing description is illustrative of particular embodiments of the invention, but is not meant to be a limitation upon the practice thereof. The following claims, including all equivalents thereof, are intended to define the scope of the invention.

The invention claimed is:

1. A particle separator for separating small particles from large particles from a material M comprising:

a separator housing having a first end and a second end, said separator having an air input;

a central magnetic axis that attracts unwanted foreign spurious metal shavings or metal particulate from the material M inputted to the separator, where said central magnetic axis serves as a mounting shaft;

a spiral blade mounted around said mounting shaft;

a peripheral mesh screen suspended within said separator housing that surrounds and is in mechanical communication with edges of said spiral blade;

a particle feed bin coupled to an end of said mounting shaft and having a surface, the surface defining a hole to feed the material from said bin along said shaft towards the second end;

wherein said central magnetic axis further comprises an air conduit within said central magnetic axis, said air conduit in fluid communication with said air input and having one or more slits that provide an outward flow of air that urges the material M into moving contact with the peripheral mesh screen; and wherein said spiral blade is stationary and air pressure provided via said air input pushes the material down the spiral blade, with the angle of the spiral blades pushing the material M against the peripheral mesh to separate large and small particles from the material M into separate streams.

2. The separator of claim 1 further comprising a large particle outlet for collecting large particulate proximal to the second end of said shaft.

3. The separator of claim 1 further comprising a small particle outlet for collecting small particulate proximal to the second end of said shaft.

4. The separator of claim 1 wherein said mesh screen has a mesh size such that the small particulate has a small particle dimension less than the mesh size so as to pass through said mesh and leaving the larger particulate with a large particulate dimension larger than the mesh size within said mesh.

5. The separator of claim 1 wherein said mesh screen has a conical shape and said spiral blade has a tapered shape that corresponds to the contours said mesh screen.

6. The rotary separator of claim 1 wherein said mesh screen has a cylindrical shape and said spiral blade has conical dimensions that correspond to said mesh screen.

7. The separator of claim 1 wherein said housing is part or all transparent.

8. The separator of claim 1 wherein said housing is formed from one or more of sheet metal, plastics, wood, and combinations thereof.

9. The separator of claim 1 wherein said housing is cylindrical.

10. The separator of claim 1 wherein said housing has a cross-section comprising rectangular, square, or oval.

11. The separator of claim 1 wherein said housing has a length between about 6 to about 24 inches.

12. The separator of claim 1 wherein said housing has a length between about 12 to about 18 inches.

13. The separator of claim 1 wherein said housing has a length between about 14 to about 16 inches.

14. The separator of claim 1 wherein said a particle feed bin further comprises a lip seal region that fits over said first end and one or more latches engage said lip seal.

15. The separator of claim 1 wherein said mesh screen has apertures or openings that vary in shape and size along a length of said mesh screen.

16. The separator of claim 1 wherein said mesh screen has apertures or openings that are homogenous in shape and size along a length of said mesh screen.

17. A process of separating a material into component large particles and small particles comprising:

adding the material to the feed bin of the separator of claim 1;

moving said material along said spiral blade by positive air pressure; and collecting the small particles external to said mesh and the large particles proximal to the second end of said shaft to separate the material; and removing said central magnetic axis to collect any accumulated unwanted foreign spurious metal shavings or metal particulate.

18. The process of claim 17 wherein the material is a majority by weight of thermoplastic regrind.

19. The separator of claim 1 wherein said separator operates in a closed air system with said air input attached to a compressor or pump.

* * * * *